United States Patent [19]

Raffelsiefer et al.

[11] 4,298,223

[45] Nov. 3, 1981

[54] DOOR LOCK, ESPECIALLY FOR MOTOR VEHICLE DOORS

[75] Inventors: Kurt Raffelsiefer, Velbert; Herman W. Kurth; Fritz Häberle, both of Sindelfingen, all of Fed. Rep. of Germany

[73] Assignee: Arn. Kiekert Soehne and Daimler-Benz Aktiengesellschaft, Fed. Rep. of Germany

[21] Appl. No.: 30,546

[22] Filed: Apr. 16, 1979

Related U.S. Application Data

[63] Continuation-in-part of Ser. No. 898,684, Apr. 21, 1978, abandoned.

[30] Foreign Application Priority Data

Apr. 21, 1977 [DE] Fed. Rep. of Germany ..... 2717696
Jun. 22, 1977 [DE] Fed. Rep. of Germany ..... 2728042

[51] Int. Cl.[3] ..... E05C 3/26
[52] U.S. Cl. ..... 292/216; 292/DIG. 38
[58] Field of Search ..... 292/DIG. 38, 216, 280, 292/DIG. 69, 201

[56] References Cited

U.S. PATENT DOCUMENTS

| | | | |
|---|---|---|---|
| 2,842,075 | 7/1958 | Rataicyah | 292/201 X |
| 3,378,291 | 4/1968 | Brian | 292/DIG. 14 |
| 3,580,624 | 5/1971 | Gmeiner et al. | 292/216 |

*Primary Examiner*—Richard E. Moore
*Attorney, Agent, or Firm*—Craig & Antonelli

[57] ABSTRACT

A motor vehicle door lock which includes an essentially U-shaped housing, a rotary catch, a locking pawl, and a locking button with the rotary catch being arranged in a plane parallel to the front surface ad cover plate and the locking pawl being rotatably supported beneath the rotary catch. To determine whether a door is properly locked, the locking pawl includes an actuating lever arm which projects beyond a bearing bolt with a microswitch, arranged between the rotary catch and the cover plate, including an actuating spring that selectively cooperates with the actuating lever arm in dependence upon the condition of the door lock.

12 Claims, 5 Drawing Figures

DOOR LOCK, ESPECIALLY FOR MOTOR VEHICLE DOORS

This application is a continuation-in-part application of U.S. Application Ser. No. 898,684, filed Apr. 21, 1978, and now abandoned.

The present invention relates to a door lock, especially for motor vehicle doors, with an essentially U-shaped housing having a front surface and a cover plate, a rotary catch, especially a forked catch, a locking pawl, and a locking button with the rotary catch arranged in a plane substantially parallel to the front surface and cover plate, and with the locking pawl rotatably supported beneath the rotary catch about or with a bearing bolt, and equipped with a detecting device. The term "detecting device" or "testing device" is used herein to denote a mechanism of a motor vehicle door lock which permits a determination as to whether the locking pawl is or is not in a locking position.

With motor vehicle door locks of the aforementioned type, as known in the prior art, the detecting device is generally constructed as a mechanical device by which the so-called locking button or locking lever, regularly associated with a door lock, cannot be actuated if the locking pawl is not in the locking position. The lock button is designed to actuate a locking mechanism for displacing a locking pawl into the locking position so as to prevent a locked motor vehicle door lock from being opened from outside of the vehicle. In general, to actuate the locking mechanism, the lock button has to be depressed. If the lock button cannot be depressed, then this provides an indication for the driver of the motor vehicle concerning an improper closure condition of the motor vehicle door whereby the driver will then be induced to thereby completely close the door. If such a motor vehicle door lock is located at the rear doors of the motor vehicle or even at the tailgate of a station wagon, then the lock button is generally out of the reach of the driver and, consequently, a determination as to whether or not the motor vehicle door is properly closed can be detected or tested by the driver only in a complicated manner.

In known door locks of the type disclosed in, for example, German Pat. No. 16 53 957 and U.S. Pat. No. 3,580,624, the arrangement is thereby made in such a manner that the rotary catch or a part coupled therewith includes a control cam which is detected by a spring-loaded locking lever which by itself or in conjunction with a further level actuates a microswitch. A disadvantage of this arrangement resides in the fact that the construction is relatively expensive. Consequently, such constructions with a microswitch have not been used commercially heretofore in practice.

The present invention is therefore concerned with the task of eliminating the aforementioned drawbacks and to so further develop a motor vehicle door lock of the type described above that a mechanical detection device is no longer necessary but can be replaced instead by aggregates and units of an electrotechnical type with these aggregates and units being accommodated in a simple and operationally reliable manner within the housing of the motor vehicle door lock. A testing of the detecting device can thereby take place without difficulty by way of a control lamp within an area of the driver's seat possibly with a push-button actuation for testing.

Moreover, the present invention is concerned with the task of also providing a door lock of the aforementioned type such that a microswitch is actuated in a very simple manner and without the need of expensive, additional structural parts and, more particularly, that the microswitch is actuated only when the rotary catch, which has a main locking position and a pre-locking position, is in the main locking position.

As a solution to the underlying problems, the present invention proposes providing a locking pawl which includes an actuating lever arm which projects beyond a bearing bolt with a microswitch being arranged between the rotary catch and the cover plate as well as above the locking pawl. A downwardly extending actuating or triggering spring is operatively associated with the microswitch and the actuating lever arm so that the actuating lever arm alternately cooperates with the actuating or triggering spring so as to actuate the microswitch.

Additionally, the present invention proposes that the locking pawl, in the pre-locking position of the rotary catch, has a fall-in or engaging depth which is different from the fall-in or engaging depth in the main locking position of the rotary catch and that an electric control switch differentiates between the pre-locking position and the main locking position.

In one embodiment of the present invention, the electric control switch has an actuating or triggering device which projects into the pivot area of the locking pawl so as to be actuatable by the locking pawl when the locking pawl is in the main locking position.

Of particular significance is a construction according to the present invention which differentiates, during an actuation or triggering of the electric control switch, between a main locking position and a pre-locking position wherein a rotary catch is used that includes a main detent or locking leg and a pre-locking leg. The construction is thereby characterized in that the main locking leg displaces the actuating lever arm with a larger predetermined adjusting or displacement path than the pre-locking leg, and that only with an adjustment of the actuating lever arm offering the predetermined adjusting path, the actuating or triggering spring can be actuated to operate the microswitch. In accordance with an advantageous feature of the present invention, the microswitch is arranged to a rear of the rotary catch, as viewed in an insertion direction of the catch or latch bolt which alternately cooperates with the rotary catch.

To provide for a simple and yet particularly safe installation and accommodation of the microswitch, according to the present invention, the microswitch, on the one hand, is embedded in a lining of a synthetic resinous plastic material or rubber which is inserted into the housing between the rotary catch and the cover plate whereas, on the other hand, the microswitch abuts at the cover plate with the cover plate being provided with apertures for a passage of electric cables or wires or for insertion of a plug system. If the distance between the microswitch and the actuating lever arm of the locking pawl requires it, the actuating or triggering spring may have a free lever arm which extends in a direction toward the actuating lever arm of the locking pawl and be provided with a corresponding elbow or bent-off portion.

In accordance with another feature of the present invention, the electric control microswitch includes an actuating or tripping device which is not constructed as a separate structural part such an additional lever in the door lock, but is formed from a structual part integrated with the control switch so that the actuating or triggering device may thereby be actuated directly by the locking pawl. However, it is also possible, in accordance with the present invention, to provide the locking pawl with an actuating lever arm or with an actuating extension whereby the tripping device of the control switch is then coordinated to this actuating lever arm or actuating extension.

According to an embodiment of the present invention, the actuating or tripping device is then constructed as an actuating or triggering spring which projects with a free lever arm into a pivot range of the locking pawl and is actuatable by the locking pawl in the described manner when the locking pawl is in the main locking position.

While the construction of the electric control switch utilized with the present invention may be of any known type, a construction of the door lock of the present invention is characterized by simplicity and reliability in operation when the electric control switch is constructed as a commercially available microswitch which includes an actuating push-button with the actuating or triggering spring being constructed as a unilaterally secured leaf spring extending over the actuating push-button and projecting beyond the microswitch.

The differentiation between the pre-locking position and main locking position can be realized itself in different ways. Thus, this can be realized by circuit means utilizing a switch which is constructed exclusively for on and off; however, for the purpose of the present invention, one can also utilize a switch which in the position of pre-locking and in the position of main locking, actuates different contacts to which different circuits are coordinated. Such a switch differentiates the switching positions of (a) door non-actuated, (b) pre-locking position, and (c) main locking position, thereby representing a preferred embodiment of the present invention.

The attained advantages of the present invention reside in the fact that, with a motor vehicle door lock according to the present invention, the testing or detecting of the condition of the door lock no longer operates purely mechanically by requiring that testing to be carried out by way of a lock button which can either be pressed in or not. According to the present invention, the testing may take place by way of a microswitch which simultaneously represents an electric sensor. This structural part is accommodated in the motor vehicle door lock according to the present invention within the housing, safe against destruction and against operation disturbances, but yet which can be installed in a simple manner.

For this purpose, the present invention utilizes an ordinarily free space between the rotary catch and the cover plate of the housing in a motor vehicle door lock so that one is able to get along with few and operationally reliable mechanical structual parts for the installation and actuation of the microswitch.

Of particular importance is the fact that the arrangement can be made without difficulty and without additional structural parts in such a manner that the microswitch differentiates between the door locking positions, pre-locking, on the one hand, and main locking, on the other hand. Thus, with a door lock according to the present invention, the testing of the position of the rotary catch can be carried out without difficulties from a control switch and, more particularly, without requiring additional structural lock parts.

The rotary catch may be provided with two detent faces which are aligned radially with respect to a fulcrum or pivot point of the catch with the detent faces being located in different peripheral positions of the rotary catch. A pawl may be rotatably supported at the door lock, which pawl is provided with a blocking tooth cooperating with the detent faces of the rotary catch, with the pawl being tensioned by a spring force and with the blocking tooth, in a direction toward the fulcrum, so that the blocking tooth engages in front of the detent faces of the rotary catch into a defined engagement depth.

The rotary catch may assume three different rotary positions defined peripherally thereof, namely, an open position defined by a stop, a preliminary locking position defined by one of the detent faces and by the blocking tooth, and a main locking position defined by the other detent face and the blocking tooth.

In accordance with further advantageous features of the present invention, the engagement depth of the pawl into the rotary catch in its open position and in its preliminary locking position is smaller than the engagement depth in the main locking position. Moreover, a lever is operatively connected with the pawl with an electric control switch such as a microswitch arranged in the door lock in a pivotal region of the lever. The microswitch being provided with a triggering means and being aligned with the triggering means toward the lever in such a way that the microswitch responds only in the position of the pawl and/or of the lever corresponding to an engagement depth of the main locking position.

Accordingly, it is an object of the present invention to provide a motor vehicle door which avoids, by simple means, the aforementioned shortcomings and drawbacks encountered in the prior art.

Another object of the present invention resides in providing a door lock, especially for motor vehicle doors, with a testing or detecting device for determining whether the vehicle door is fully closed, which permits simple testing of any door by the driver, including rear doors or tailgates of station wagons.

A further object of the present invention resides in providing a motor vehicle door lock of the type described hereinabove which is relatively simple in construction, utilizes relatively few, inexpensive parts, and which can be readily installed into an already existing space of a door lock in order to achieve all of the aforementioned aims and objects.

A still further object of the present invention resides in providing a motor vehicle door lock with a door closure detecting device which eliminates the need for a mechanical actuation of a door lock button.

These and other objects, features, and advantages of the present invention will become more apparent from the following description when taken in connection with the accompanying drawings which show, for the purposes of illustration only, two embodiments in accordance with the present invention, and wherein.

Figure 2:
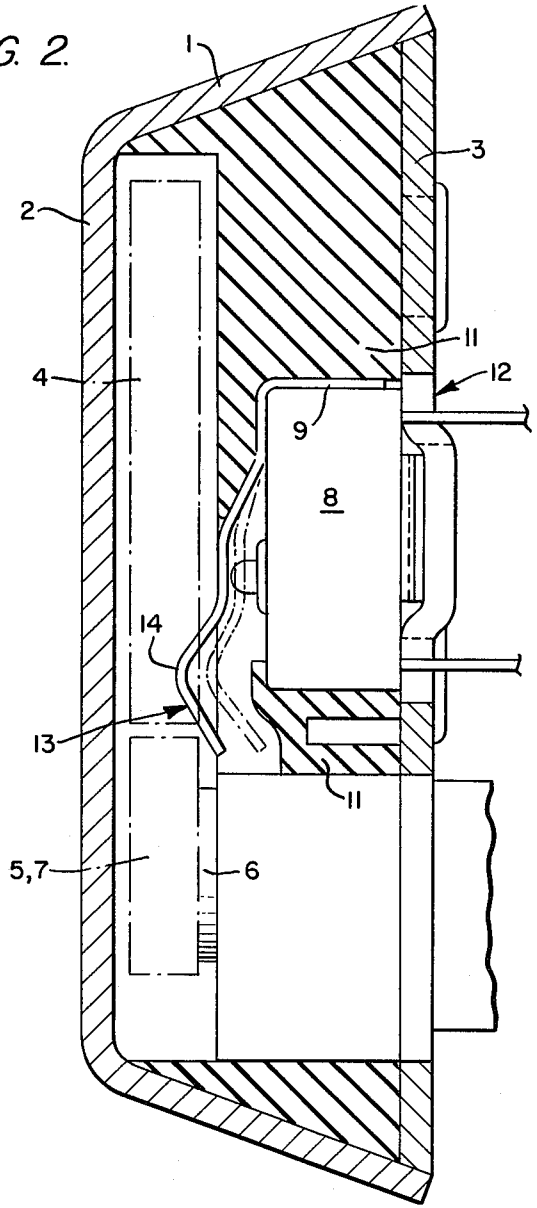
FIG. 2 is a cross-sectional view taken along the line A—A of FIG. 1.
Figure 1:
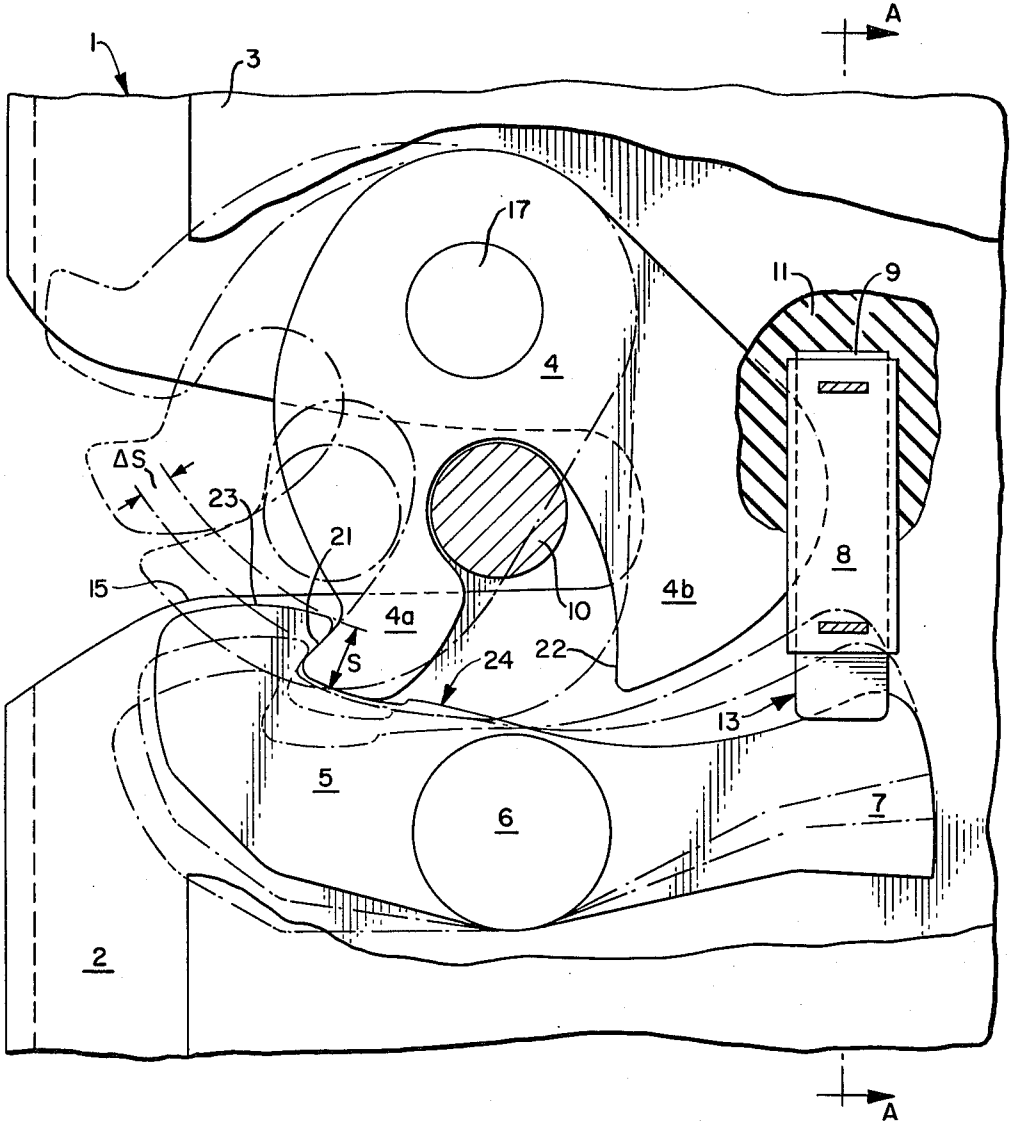
FIG. 1 is a partial elevational view of a motor vehicle door lock according to a first embodiment of the present invention, as viewed in a direction from the cover plate of the lock housing with the cover plate thereof partially broken away, wherein three different lock positions are drawn in a nested relationship with different lines.

Referring now to the drawings wherein like reference numerals are used throughout the various views to designate like parts and, more particularly, to FIGS. 1 and 2, according to these figures, a motor vehicle door lock includes an essentially U-shaped housing generally designated by the reference numeral 1 which housing 1 includes a front face 2 and a cover plate 3, arranged tangentially to a circle about a hinge axis of a door (not shown), with a rotary catch or bolt 4, constructed as a bifurcated catch, and a locking pawl 5 being accommodated in the housing 1. The rotary catch 4 is rotatable about a bearing pin 17 and is arranged in a plane parallel to the front face 2 and cover plate 3 with the locking pawl 5 being disposed beneath the rotary catch and being rotatable about or with a bearing pin or bolt 6.

The lock is installed in a vehicle door in such a manner that a latch or check slot 15, which serves to receive a latch bolt or check pin 10, fixedly attached to a cross beam or column (not shown) of the motor vehicle door, is located in the housing 1 tangentially to a circular motion of the door lock during a pivoting of the door.

In the embodiment of FIGS. 1 and 2, the latch bolt or check pin 10 is disposed radially with respect to a hinge axis (not shown) of the vehicle door. A special scanning or detecting mechanism is operatively associated with the motor vehicle door and serves to detect or test whether the locking pawl 5 is or is not in a closed or locking position, i.e., whether the motor vehicle door is or is not properly closed or locked.

As can be seen most clearly from FIG. 1, the locking pawl 5 includes an actuating lever arm 7 which projects beyond the bearing bolt or pin 6. An actuating mechanism of a conventional construction (not shown) for the locking pawl 5 also engages at the actuating lever arm 7. A microswitch 8 is disposed between the rotary catch 4 and the cover plate 3 as well as above the locking pawl 5. The microswitch 8 is provided with a downwardly projecting actuating or trigger spring 9. As can be seen from a comparison of FIGS. 1 and 2, the actuating lever arm 7 alternately cooperates with the actuating or trigger spring 9. In the illustrated embodiment, the arrangement is made in such a manner that the microswitch 8 is additionally located to the rear of the rotary catch 4, as viewed in an insert direction of the latch bolt or check pin 10.

As also shown in FIG. 1, the rotary catch 4 includes a forward main locking or detent leg 4*a* and a rearward pre-locking leg or preliminary detent 4*b*. The microswitch 8 differentiates, on the basis of a corresponding construction of the rotary catch 4 and the locking pawl 5, between the locking positions of "entirely open" and "preliminary locking condition," on the one hand, and the "primary locking condition," on the other hand.

In the "entirely open" position, indicated in dot-dash lines in FIG. 1, a blocking or detent tooth 23 contacts or engages with a tip thereof a circular arc-shaped outer contour of the broader rearward preliminary detent leg 4*b* of the rotary catch 4. The blocking tooth 23 being radially pressed against the rotary catch 4 by the force of a spring (not shown) which acts in a clockwise direction on the locking pawl 5.

In the "preliminary locking condition" illustrated in dotted lines in FIG. 1, the detent or blocking tooth 23 engages behind the detent surface 22 of the broader preliminary detent leg 4*b* of the rotary catch 4. The detent surface 22 is inclined even somewhat negatively with respect to the radial direction, i.e., is provided with a certain undercut and, correspondingly, the operating flank of the detent or blocking tooth 23 is likewise constructed so as to be inclined.

By virtue of the above-described arrangement, the locking pawl 5 engages radially, with a maximum depth, the rotary catch, on the basis of the spring action, directly after rims of the mutual detent surfaces have slid upon each other. However, on a top side of the locking pawl 5, a deflecting lug 24 is arranged which, in the "preliminary locking condition," cooperates with a circular contour of the broader preliminary locking leg 4*b* in such a manner that the locking pawl 5 may, only to a limited extent, engage radially.

Only in the main locking conditions, shown in solid lines in FIG. 1, wherein the narrower main locking or preliminary detent leg 4*a* enters with its likewise undercut primary locking surface 21 into the operating range of the detent tooth 23, is it possible for the locking pawl 5 to fully engage, to an engagement depth designated S. The deflecting lug 24 does not inhibit such a deeper engagement due to the lesser width of the main detent leg 4*a*. It can be seen that thereby a greater engagement depth results by a difference amount $\Delta S$. Accordingly, the narrower main locking or detent leg 4*a* adjusts the actuating lever arm 7 with a longer adjustment stroke than the preliminary detent leg 4*b*. Thus, it is insured that only when the actuating lever arm 7 is adjusted with the setting distance S, the main locking or detent leg 4*a* displaces the actuating lever arm with a larger displacement path than the pre-locking or preliminary detent leg 4*b* so that the trigger spring 9 can be activated in the sense of a triggering to activate or trip the microswitch 8.

As evident from the above-described arrangement in accordance with the present invention, the locking or latching pawl 5 has a fall-in or engaging depth in the pre-locking position of the rotary catch which is different from the fall-in or engaging depth in the main locking position of the rotary catch 4 with the microswitch 8 being activated or triggered by the triggering spring 9 which projects into a pivot area of the locking pawl 5 so as to be actuatable thereby when the locking pawl 5 is in the main locking position. This could take place directly by the latching or locking pawl 5 if one dispenses with the actuating lever arm 7.

In order to fasten or attach the microswitch 8 in the housing and in order to be able to mount the same in a simple manner, the present invention proposes that the microswitch 8 is embedded, on one side thereof, in a lining 11 of synthetic resinous material or rubber which is inserted into the housing 1. The microswitch 8, on the other side thereof, abuts at the cover plate 3. The cover plate 3 includes recesses or apertures generally designated by the reference numeral 12 for passage of electric cables or the like and/or for the insertion of a plug system. The actuating or triggering spring 9 is provided with a free lever arm generally designated by the reference numeral 13, which extends up to the actuating arm lever 7, and which is provided with a corresponding bent-off portion or elbow 14 extending in a direction toward the actuating lever arm 7.

The terms "top" and "bottom" utilized in the above description are merely used for describing the illustration of FIGS. 1 and 2 but do not necessarily refer to the actual installation position of the door lock in a motor vehicle door. Thus, it is also possible to install the door lock mechanism according to the present invention, displaced by 90° or by 180° from the position shown in FIGS. 1 and 2 of the drawings.

Figure 3:
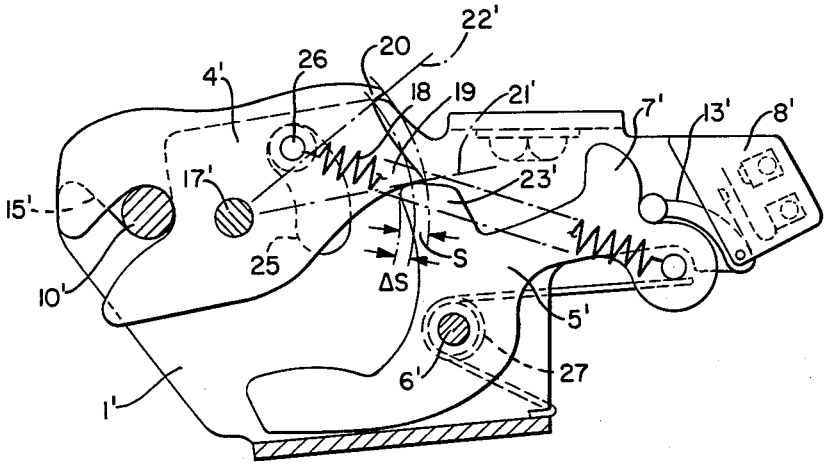
FIGS. 3–5 are partial cross-sectional views of a motor vehicle door lock according to a second embodiment of the present invention in various locking positions.
Figure 4:
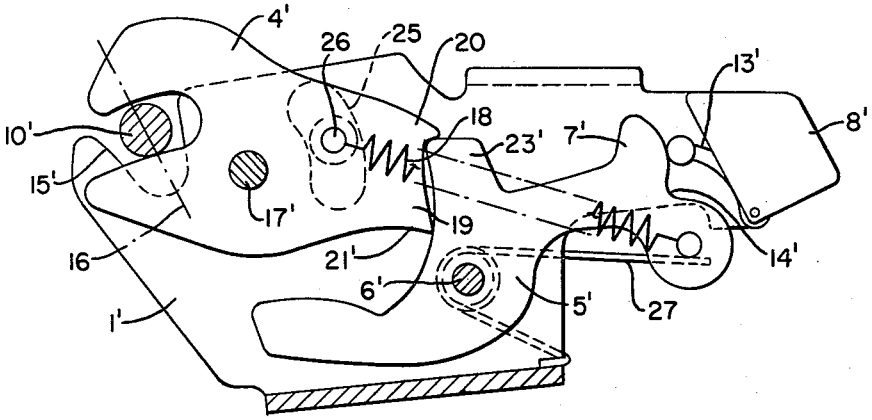
Figure 5:
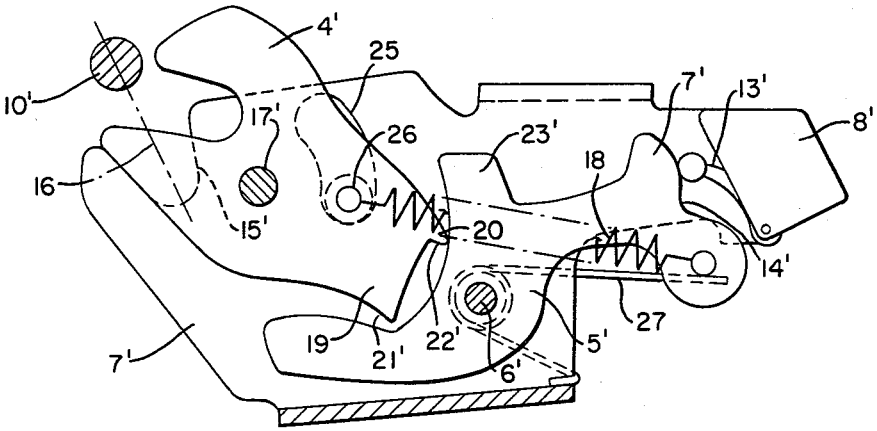

The vehicle door lock of FIGS. 3–5 may be fixedly arranged in a vehicle post or arranged so as to be movable in a vehicle door. Preferably, the vehicle lock is installed in a door, rear flap, or tailgate of a motor vehicle with a latch bolt or check pin 10' associated with the vehicle lock, extending in parallel to the hinge axis (not shown) of the door or tailgate which axis is assumed to be approximately perpendicular to a relative direction of movement of the latch bolt 10, shown in dot-dash lines 16. The vehicle lock is then installed within the vehicle door at right angles to the hinge axis.

As with the embodiment of FIGS. 1 and 2, as shown in FIGS. 3–5, the vehicle door lock includes an essentially U-shaped housing generally designated by the reference numeral 1' in which is arranged a rotary catch 4' constructed as a forked catch, so as to be pivotable about a bearing pin 17' with a fulcrum point of the rotary catch 4' being disposed eccentrically with respect to a forked slot of the rotary catch 4' and/or the corresponding bearing pin 17' is disposed laterally beside a latch or check slot 15' in the housing 1'. The vehicle lock is installed within the vehicle door so that the latch or check slot 15' lies on a line 16 of the relative direction of movement of the latch or check pin 10'.

The rotary catch 4' is extended beyond the bearing pin 17' and a stay bolt 26, extending toward the outside of the lock through a slotted hole 25, is attached to the extension of the rotary catch 4'. The slotted hole 25 is arranged in one side wall of the housing 1' and extends in the manner of a circular arc concentrically around the bearing pin 17'. A rotary catch spring 18 is fastened into the stay bolt 26 with the catch spring 18 being constructed as a tension spring and tending to pivot the rotary catch 4' in a clockwise direction toward an opening position (FIG. 5).

Two detent or locking teeth are also provided on the extension portion of the rotary catch 4'. One of the detent or locking teeth 19 forms a main detent or locking detent tooth 20. Each of the detent or locking teeth 19, 20 are provided with detent or locking faces disposed in opposition to a face of the locking pawl 5', described more fully hereinafter. The detent faces or locking of the teeth 19, 20 are radially aligned toward the fulcrum 17' of the rotary catch 4', as shown most clearly by the dot-dash lines in FIG. 3.

The main detent or locking tooth 19 has a main detent face 21' and the preliminary or pre-locking detent tooth 20 has a preliminary detent face 22'. During a pivoting of the rotary catch 4', the detent teeth 19, 20 move along a circular arc. The bearing pin 6' for the locking pawl 5' is arranged tangentially to the circular arc with the locking pawl 5' carrying a blocking path 23' which extends in a direction toward the detent teeth 5'. The locking pawl 5' also includes a lug-type actuating lever arm 7' which is engaged by a vigorous pawl spring 27 which is adapted to pivot the locking pawl 5' in a counterclockwise direction with the blocking tooth 23' in a direction toward the rotary catch 4'. A microswitch 8' is arranged outside of a motion range of the actuating lever arm 7' in close proximity to the lever arm 7'. A lever arm 13' of the microswitch 8' is adapted to close the contacts and rests on a peripheral surface of the actuating lever arm 7' and interacts with the peripheral surface thereof. A recess 14' is provided in the peripheral surface of the actuating lever arm 7' with the lever arm 13' being adapted to engage the recess 14' in a predetermined locking position of the vehicle lock and/or of the locking pawl 5' shown in FIG. 3. Only with the lever arm 13' in engagement with the recess 14', is it possible for the microswitch 8' to respond, for example, the contacts contained in the microswitch 8' are opened. In the two other closed positions shown in FIGS. 4 and 5, the microswitch 8' does not respond, for example, the corresponding contacts of the microswitch 8' are closed.

To obtain the different positions of the locking pawl 5' in the main locking position of FIG. 3, on the one hand, the "preliminary locking condition" of FIG. 4, or the "entirely open" condition of FIG. 5, the vehicle is provided with the following additional elements.

As shown most clearly in FIGS. 4 and 5, the detent face 21', at the main detent tooth 19, is not limited by any shoulders or abutments in a direction toward the bearing pin 17 of the rotary catch 4' so that the blocking or detent tooth 23' of the locking pawl 5' can radially engage without limits. With respect to a crown circle of the two detent teeth 19, 21, common to both teeth and lying concentrically to the bearing pin 17, the blocking tooth 23' may have an engagement depth designated S (FIG. 3). The engagement depth S is limited by the abutting of the actuating lever arm 7' against the housing 1' in a manner not illustrated in detail in the drawings. The thus-effected peripheral position of the locking pawl 5' and/or the actuating lever arm 7' is selected so that the recess 14' in the peripheral surface of the actuating lever arm 7' enters such a relative position with respect to the microswitch 8' that the lever arm 13' can fully engage the recess 14' in a manner which triggers the microswitch 8'.

To open the vehicle door or tailgate, the locking pawl 5' must be pivoted in a clockwise direction against a force of the pawl spring 27 whereby the actuating lever arm 7' moves downwardly. During this step, the end of the lever arm 13' slides along the lug-shaped peripheral surface of the lever arm 7' out of the recess 14' and the lever arm 13' is pivoted in a clockwise direction so that the microswitch 8' no longer responds. In all positions of the locking pawl 5', even those which are only temporary, which are offset in the illustration of FIG. 3 in a clockwise direction with respect to the illustrated position of the pawl, the lever arm 13' must be deflected in a way which eliminates a response by the microswitch 8'. Temporary pivotal positions of the locking pawl 5' are, in particular, also those wherein the blocking or detent tooth 23' is lifted beyond the tip of the detent tooth 19 and/or 20, that is, pivotal positions of the locking pawl 5' wherein the latter is swung to the extreme right (not shown).

As shown in FIG. 4, in contrast to the main detent or locking tooth 19, the preliminary detent tooth 20, shown in engagement in FIG. 4, is provided with an extension or shoulder which serves for limiting the engagement depth of the blocking or detent tooth 23' in the "preliminary locking position." The engagement depth of the blocking or detent tooth 23' in the "preliminary locking position" is smaller than the engagement depth S in the main locking position by an increment designated $\Delta S$. The limitation of this engagement depth S to lower values results not only from the abutment shoulders in a zone of the preliminary detent face 22', but also from the main detent or locking tooth 19 itself which likewise contacts a front of the blocking or detent tooth 23' facing the bearing pin 17'. For this purpose, a front of the blocking or detent tooth 23' is formed of a circular-arc contour, at least in certain areas thereof, so that the circular arc in the "preliminary locking condition," shown in FIG. 4, is disposed concentrically to the bearing pin 17' and also the tip of the main detent tooth 19 is in contact therewith. The contact point is still above the bearing pin 6' for the locking pawl 5' so that also the tip of the main detent tooth 19 functions to limit the engagement depth S of the locking pawl 5' in the "preliminary locking condition."

In the "entirely open position" of the vehicle lock, illustrated in FIG. 5, the latch or check pin 10' is located outside of the region of the check slot 15' and also outside of the bifurcate slot of the rotary catch 4' and both detent or locking teeth 19, 20 are pivoted downwardly beyond the tip of the blocking or detent tooth 23'. The rotary catch 4' is tensioned in an extreme position by the rotary catch spring 18 which is offset in the clockwise direction with respect to the other positions wherein the stay bolt 26 contacts an end of the slotted hole 25 which becomes effective as a stop. The rotary catch spring 18 is greatly relaxed or relieved of tension during this step. Furthermore, the point of action of the rotary catch spring 18 at the stay bolt 26 is approximately in a line between the other suspension point of the rotary catch spring 18 and the bearing pin 17' so that a very small pivotal movement results which is effective on the rotary catch 4'. Very small torques are sufficient to pivot the rotary catch 4' back again from the extreme position.

In the "entirely open position," the rotary catch 4' assumes a peripheral position defined by the stay bolt 26 and the end of the slotted hole 25, the peripheral position of the locking pawl 5' is determined by the tip of the preliminary detent or pre-locking tooth 20 and by the circular-arc-shaped front of the blocking or detent tooth 23' facing the rotary catch 4'. The preliminary detent or pre-locking tooth 20 is there, in the "entirely open position," approximately at the same location in contact where the main detent or locking tooth 19 is in contact in the "preliminary locking position" shown in FIG. 4. Since the tip of the preliminary detent or locking tooth 20 lies approximately on the same circular arc as the tip of the main detent or locking tooth 19, the peripheral position of the locking pawl 5' in the "entirely open position" is approximately the same as in the "preliminary locking position."

The locking pawl 5' has a further lever arm approximately diametrically opposite to the actuating lever arm 7' which is of the same size as the lever arm 7' with the further lever arm severing for mass equalization of the locking pawl 5'. The center of gravity of the locking pawl 5' is located in maximally close proximity to the bearing pin 6' so that, in case of a vehicle crash resulting in very high instantaneous acceleration forces effective on the individual parts of the vehicle lock, no mass-resultant torques are effective on the locking pawl 5' which may lead to an unintended opening of the vehicle door at precisely a particularly critical point in time. In a similar fashion, the rotary catch 4' may also be approximately mass-equalized.

While we have shown and described only two embodiments in accordance with the present invention, it is understood that the same is not limited thereto, but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A door lock, comprising a fixed locking pin means, a rotary catch means rotatably mounted and adapted to engage the locking pin means upon a closing of the door, the rotary catch means being positionable in an open position, a preliminary locking position, and a main locking position, and means for determining a closure condition of the door, characterized in that the rotary catch means includes at least two radially aligned detent means disposed at different peripheral portions of the rotary catch means, a blocking means is rotatably supported at the lock and is adapted to engage in front of the detent means at defined engagement depths corresponding to the open, preliminary locking, and main locking positions, the engagement depth of the blocking means into the rotary catch means in the open and preliminary locking positions is smaller than the engagement depth in the main locking position, the closure condition determining means includes a microswitch means arranged in the door lock, the microswitch means includes a triggering means, and means are operatively connected to the blocking means so as to permit a pivotal movement in a direction of the microswitch means for actuating the triggering means such that the microswitch means responds only in a position of at least one of the blocking means and means operatively connected thereto at an engagement depth corresponding to the main locking position.

2. A door lock according to claim 1, characterized in that the blocking means includes a rotatably mounted pawl having a blocking tooth cooperable with the detent means of the rotary catch means, spring means are provided for tensioning the blocking tooth in a direction of the detent faces, and in that the means operatively connected with the blocking means includes a pivotally mounted lever connected to the pawl.

3. A door lock according to claim 2, characterized in that the rotary catch means is constructed as a bifurcated member adapted to surround the fixed locking pin in a closed position of the door.

4. A door lock according to claim 3, characterized in that the triggering means includes a triggering spring acted upon by the pivotally mounted lever connected to the pawl, and in that the detent means includes detent faces peripherally spaced on the rotary catch means.

5. A door lock according to one of claim 1, 2, 3, or 4, characterized in that a stop means is provided and cooperates with the rotary catch means so as to define the open position, the preliminary locking position is defined by cooperation between the blocking means and one of the detent means and the main locking position is defined by cooperation between the blocking means and the other of the detent means.

6. A door lock according to claim 5, comprising an essentially U-shaped housing means having a front surface and a cover plate, characterized in that the microswitch means is arranged between the rotary catch means and the cover plate; the microswitch means is embedded in a lining means which is insertable into the housing means with the microswitch means abutting the cover plate at one end thereof, and in that aperture means are provided in the cover plate for accommodating wire leads to the microswitch means or accommodating a plug-type connection.

7. A door lock according to claim 6, characterized in that the spring means includes a free lever arm which extends in a direction toward the blocking means.

8. A door lock, comprising an essentially U-shaped housing means having a front surface and a cover plate, a rotary catch means having a main locking leg and a pre-locking leg, locking pawl means and locking knob means, the rotary catch means being arranged in a plane substantially parallel to the front surface and cover plate and the locking pawl means being supported beneath the rotary catch means so as to be rotatable about an axis of a bearing bolt, and means for determining a closure condition of the door, characterized in that the locking pawl means includes an actuating lever arm projecting beyond the bearing bolt, the closure condition determining means includes a microswitch means arranged between the rotary catch means and the cover plate, said microswitch means including a triggering spring cooperable with the actuating lever arm, the microswitch means is embedded in a lining means insertable in the housing means and abuts at the cover plate, the cover plate is provided with aperture means for accommodating wire leads to the microswitch or a plug-type coupling, the main locking leg is adapted to displace the actuating lever arm along a greater adjusting path than the pre-locking leg, and in that the triggering spring is actuatable to operate the microswitch means only in a position of the actuating lever arm with the larger adjusting path of the main locking leg.

9. A door lock according to claim 8, characterized in that the door lock is a motor vehicle door lock, and in that the microswitch means is arranged vertically spaced from the locking pawl means.

10. A door lock according to one of claims 8 or 9, characterized in that the triggering spring includes a free lever arm which extends in a direction toward the actuating lever arm of the locking pawl means and is provided with a corresponding bent-off portion.

11. A door lock, comprising an essentially U-shaped housing means having a front surface and a cover plate, rotary catch means, locking pawl means and a locking knob means, the rotary catch means being arranged in a plane substantially parallel to the front surface and cover plate and the locking pawl means being supported beneath the rotary catch means so as to be rotatable about an axis of a bearing bolt, and means for determining a closure condition of the door, characterized in that the locking pawl means includes an actuating lever arm projecting beyond the bearing bolt, the closure condition determining means includes a microswitch means arranged between the rotary catch means and the cover plate, said microswitch means including a triggering spring cooperable with the actuating lever arm, the microswitch means is embedded in a lining means insertable in the housing means and abuts at the cover plate, the cover plate is provided with aperture means for receiving cable leads for the microswitch means or a plug-type coupling.

12. A door lock according to claim 11, characterized in that the door lock is a motor vehicle door lock, and in that the microswitch means is arranged vertically spaced from the locking pawl means.

* * * * *